US005533820A

United States Patent [19]

Ambrose

[11] Patent Number: 5,533,820

[45] Date of Patent: Jul. 9, 1996

[54] KEYBOARD POSITIONING SYSTEM

[76] Inventor: Frederic C. Ambrose, 142 The Channel, Brewster, Mass. 02631

[21] Appl. No.: 551,543

[22] Filed: Nov. 2, 1995

Related U.S. Application Data

[63] Continuation of Ser. No. 306,989, Sep. 16, 1994, abandoned, which is a continuation of Ser. No. 94,109, Jul. 28, 1993, Pat. No. 5,405,204.

[51] Int. Cl.[6] ..... B41J 5/16

[52] U.S. Cl. ..... 400/472; 400/715

[58] Field of Search ..... 400/480, 481, 400/489, 472, 473, 488, 681; 248/118, 118.1, 188.2, 118.3, 918; 235/146, 145 A, 145 R

[56] References Cited

U.S. PATENT DOCUMENTS

| | | | |
|---|---|---|---|
| 293,971 | 2/1884 | Lyford | 38/107 |
| 1,189,529 | 7/1916 | Benson | 38/106 |
| 1,277,169 | 8/1918 | Anderson | 248/118.3 |
| 3,830,352 | 8/1972 | Kolpek | 400/682 |
| 3,902,034 | 4/1974 | Isozaki | 200/239 |
| 4,307,672 | 12/1981 | Shikimi | 108/139 |
| 4,481,556 | 11/1984 | Berke et al. | 400/715 |
| 4,515,086 | 5/1985 | Kwiecinski et al. | 108/96 |
| 4,545,544 | 10/1985 | Latino et al. | 248/118.3 |
| 4,616,798 | 10/1986 | Smeenge et al. | 248/281.1 |
| 4,632,349 | 12/1986 | Ansley | 248/281.1 |
| 4,664,875 | 2/1987 | Watt | 108/93 |
| 4,688,862 | 8/1987 | Fowler et al. | 312/325 |
| 4,709,972 | 12/1987 | LaBudde et al. | 312/208 |
| 4,736,689 | 4/1988 | Stanko | 108/5 |
| 4,779,922 | 10/1988 | Cooper | 248/918 |
| 4,826,123 | 5/1989 | Hannah et al. | 248/248 |
| 4,852,500 | 8/1989 | Ryburg et al. | 108/105 |
| 4,913,390 | 4/1990 | Berke | 248/176 |
| 4,923,259 | 5/1990 | Bartok | 312/208 |
| 4,976,407 | 12/1990 | Schwartz et al. | 248/118.3 |
| 5,005,669 | 5/1990 | Umebara | 186/61 |
| 5,016,367 | 5/1991 | Breen | 38/135 |
| 5,037,054 | 8/1991 | McConnell | 248/284 |
| 5,040,757 | 8/1991 | Benaway | 248/118.3 |
| 5,048,784 | 9/1991 | Schwartz et al. | 248/244 |
| 5,119,742 | 6/1992 | Simmie | 108/152 |
| 5,154,390 | 10/1992 | Bain et al. | 248/447.2 |
| 5,183,230 | 2/1993 | Walker | 248/118 |
| 5,205,631 | 4/1993 | Wegman et al. | 312/348.3 |
| 5,242,139 | 9/1993 | Aldrich | 248/118 |
| 5,273,250 | 12/1993 | Pemberton et al. | 248/918 |
| 5,320,313 | 6/1994 | Crowe | 248/231.6 |
| 5,351,897 | 10/1994 | Martin | 248/918 |
| 5,357,873 | 10/1994 | Hilton | 108/50 |
| 5,374,018 | 12/1994 | Daneshuar | 248/118 |

FOREIGN PATENT DOCUMENTS 2910855 2/1980 Germany .

OTHER PUBLICATIONS

Stack, B., "Keyboard RSI: The Practical Solution" Publication Date Unknown. pp. 29–37.

Stack, B., "Repetitive Strain Injury–Prevention and Rehabilitation," First International Congress on Ergonomics, Occupational Health and Safety and the Environment.

Patkin, M., "Neck and Arm Pain in Office Workers: Causes and Management", reproduced in Promoting health productivity in the computerized office: Models of successful ergonomic interventions, Chapter 13, (Taylor & Francis, New York) pp. 207–231, 1990.

Hedge et al, "An Experimental test of a Design Prototype Of The PROTEX System", pp. 7–12, Dec. 1, 1991.

IBM Technical Disclosure Bulletin, vol. 27 No. 1A, Jun. 1984, "Adjustable Keyboard", E. H. Frank, pp. 153–154.

IBM Technical Disclosure Bulletin, vol. 28 No. 1, Jul. 1985, "Adjustable Terminal Table", Author Unknown, pp. 747–750.

Tiffany Office Furniture Catalog, pp. 3 & 11, 1989.

Tiffany Office Furniture Catalog, pp. 13–16 & 30. 1990.

Steelcase Product Review, Oct. 27, 1986.

*Primary Examiner*—Ren Yan
*Assistant Examiner*—Anthony H. Nguyen
*Attorney, Agent, or Firm*—Steven N. Fox

[57] ABSTRACT

Disclosed is a support mechanism for mounting a keyboard to a base. In on embodiment, the support mechanism comprises a bracket member which is adapted to mount to the base and a support tray which is adapted to movably mount to the bracket member. The support tray comprises first and second side portions and a support surface adapted to receive the keyboard. The support tray is adapted such that it is movable to a position where the first side portion is disposed below the second side portion. The support mechanism further comprises a palm rest having a longitudinally disposed surface. The palm rest is movably connected to the support tray.

7 Claims, 9 Drawing Sheets

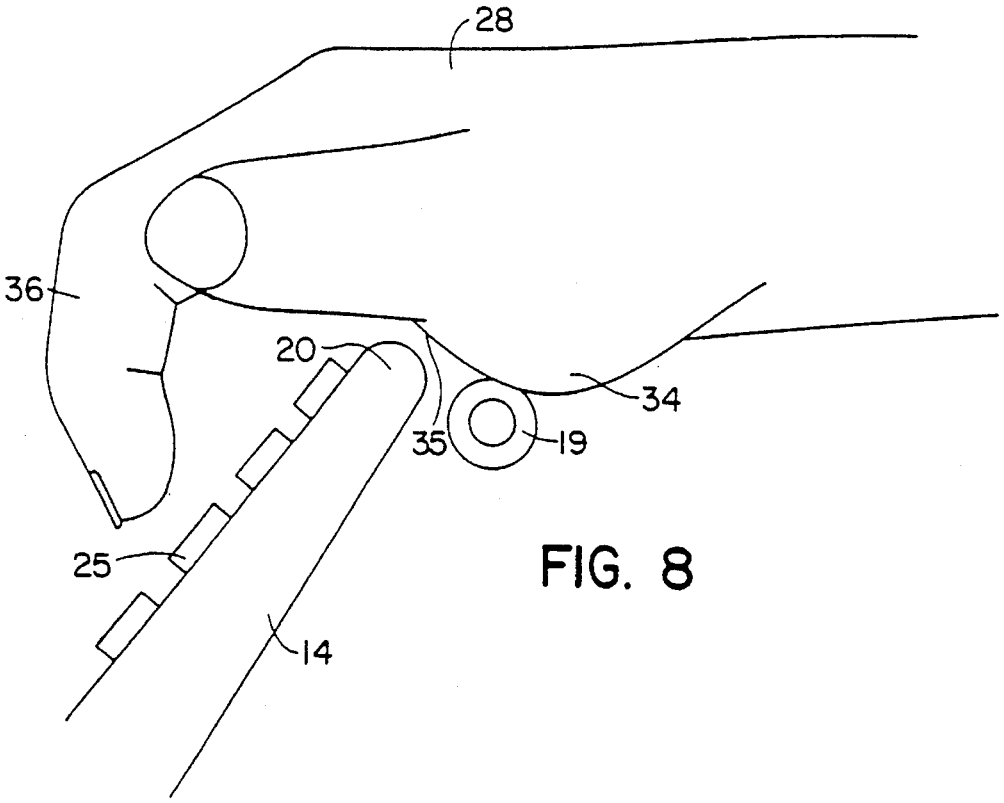
FIG. 8
FIG. 9
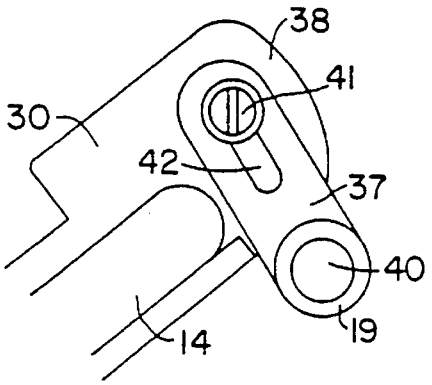
FIG. 10
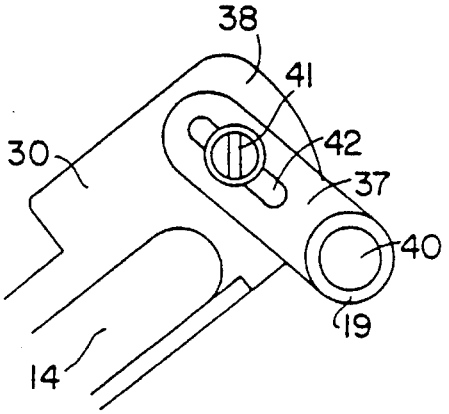

KEYBOARD POSITIONING SYSTEM

This application is a continuation of application Ser. No. 08/306,989, filed on Sep. 16, 1994, now abandoned, which is a continuation of application Ser. No. 08/094,109 filed on Jul. 28, 1993, now U.S. Pat. No. 5,405,204, which is a 35 U.S.C. §371 of application Ser. No. PCT/US92/00824 filed on Feb. 2, 1992. Application Ser. Nos. 08/094,109 and PCT/US92/00824 are a continuation-in-part of application No. 07/648,628 filed on Feb. 1, 1991, now abandoned.

BACKGROUND OF THE INVENTION

In the design of alphanumeric keyboards for use in typewriters, computers, typesetters, and certain scientific and technical instruments, it has been generally assumed that the keyboard must be tilted forward, that is, the front or operator edge of the keyboard surface must be lower than the rear edge of the keyboard surface. It will be recognized that the word keyboard in this patent application will generally be used to apply to the above types of keyboards as opposed to the keyboards found in musical instruments. The assumption that this orientation is the proper way to design a keyboard may have many origins. Certainly, from the point of view of mechanical orientation of the mechanical links found in early keyboard systems, this arrangement was probably necessary. Furthermore, for operators who are not "touch" typists, it was generally necessary and desirable that the keys be arranged in such a way that their identity, designated by symbols on the keys, could be easily visible to the operator by tipping the surface of the keyboard toward the operator. Furthermore, a somewhat mechanistic concept of how the human hand operates might well suggest that the forward tipping of the keyboard would be the most efficient way of positioning the keyboard before the operator. For these and other reasons, the forward tipping of the keyboard plane is essentially universal. Such a typical orientation is shown in FIG. 1 of the drawings.

In a separate development, the medical community has become increasingly aware of an extremely irritating, but non-lethal physical affliction, known generally as the "carpal tunnel" syndrome. In this affliction, the median nerve, which extends down the arm and out to the human hand, can be damaged at the point at which it passes through the human wrist joint. The occurrence of this affliction has a large number of unpleasant physical consequences. Generally, the affliction is associated with situations in which the hand and wrist are bent upward and backward and, while in that position, significant weight is applied to the wrist. This phenomenon which is very common among serious bicycle riders can result in long term pain and disability.

It has been observed that the carpal tunnel syndrome is frequently associated with persons who are professional keyboard operators. It appears that the forward tilt of the keyboard, which is universally accepted as the proper design for a keyboard, may well force the operator, on a long term, continuous basis, to arch back the hand and wrist in such a way that, over the many years that the operator may be sitting before the keyboard, permanent work place injury could result. This unfortunate circumstance may well be resulting in serious long term human suffering and, of course, the financial liabilities and difficulties which can be associated with such human suffering. This problem is compounded by another aspect of conventional keyboard design. Ordinarily, the operator is required to sit before the keyboard with hands extended over the keyboard. Holding the hands over the keyboard for hours at a time places tremendous stress on the operator's shoulder and neck muscles. In conventional mechanical typewriters, this uncomfortable and potentially harmful condition was constantly relieved by the peripheral activities required by the mechanical typewriter; i.e., hitting the carriage return bar and changing sheets of paper. With modern word processing systems, the operator can literally spend hours without removing his or her hands from the keyboard. The long term effect of holding one's hands over the keyboard, day after day, year after year, may well cause harmful neck and shoulder muscle stress. In addition, muscle stress and fatigue in the hands are compounded by the fact that some keyboards are not sturdily built. For instance, if the keyboard is not anchored properly, there is generally a "springiness" when typing. This bounce in the keyboard exacerbates the carpal tunnel syndrome. These and other difficulties, experienced with the prior an devices, have been obviated in a novel manner by the present invention.

It is, therefore, an outstanding object of the invention to provide a keyboard positioning system in which the keyboard is tipped backward so that the operator's hands and wrist assume a position which does not cause irritation or damage to nerves which pass through the wrist joint.

Another object of the invention is the provision of a keyboard positioning system which holds the keyboard in a position in which it is tipped backwards in order to provide a more comfortable and restful orientation for professional or long term keyboard operators.

A further objective of the present invention is to provide a keyboard system which supports the operator's hands in a proper position over the keyboard in order to minimize neck and shoulder muscle strain.

It is still a further object of the present invention to provide a keyboard system which holds the keyboard in a solid position without any bounce or shake when the user is typing.

A further object is to provide a simple keyboard system which can be easily accessed and stored away below a desk.

Another object of the present invention is to provide a keyboard positioning system in which the keyboard can be easily replaced or taken off of its support on runners.

Another object of the present invention is to provide a keyboard support that adapts to a wide range of keyboard sizes with minimum need for adjustment.

Another object of the present invention is to provide a keyboard support which is easily convertible from a temporary orientation in which ease of installation and minimum permanent effect on the work station is the priority to a permanent orientation in which maximum effectiveness is the priority.

With these and other objects in view, as will be apparent to those skilled in the art, the invention resides in the combination of parts set forth in the specification and covered by the claims appended hereto.

SUMMARY OF THE INVENTION

This invention is a keyboard positioning system which allows the keyboard to be positioned so that it is tipped backward. By "tipped backward" is meant that the rear edge, or plane, which is away from the operator, is below the forward edge, or edge closest to the operator. By orienting the keyboard in this way, the position of the operator's hand can be moved at least to the point where the plane of the hand is parallel to the line of the lower arm, thereby eliminating the stress which leads to the carpal tunnel syndrome. It has been found that, in fact, it is sometimes preferred to allow the plane of the wrist to be positioned slightly downward of the line of the lower arm. In fact, the operators have found this to be a very comfortable position in which to function. Obviously, this position is probably not acceptable to amateur keyboard operators since the visibility of the keyboard, a matter which would be important to amateurs, would be somewhat inhibited.

The keyboard positioning system would be provided with a support bar which supports the operator's hands over the keyboard. In the preferred orientation, the bar would be positioned in front of and below the front edge of the keyboard and would engage the large fleshy portion which lies at the base of the palm of the operator's hands, hereinafter proximal palm portion. The ideal is a "neutral" position.

In addition, the keyboard positioning system may also contain a stabilizing bar between the securing brackets and a tray to hold the keyboard. These elements will help support the keyboard positioning system when typing. The design allows for easy movement on a set of runners in or below a desk.

BRIEF DESCRIPTION OF THE DRAWINGS

The character of the invention, however, may be best understood by reference to one of its structural forms as illustrated by the accompanying drawings, in which:

FIG. 8 is a figurative view of the preferred orientation of the system and operator's hand.

FIG. 9 is a detailed view of a preferred orientation of the palm support.

FIG. 10 is a detailed view of another orientation of the palm support.

DESCRIPTION OF THE PREFERRED EMBODIMENT

Figure 1:
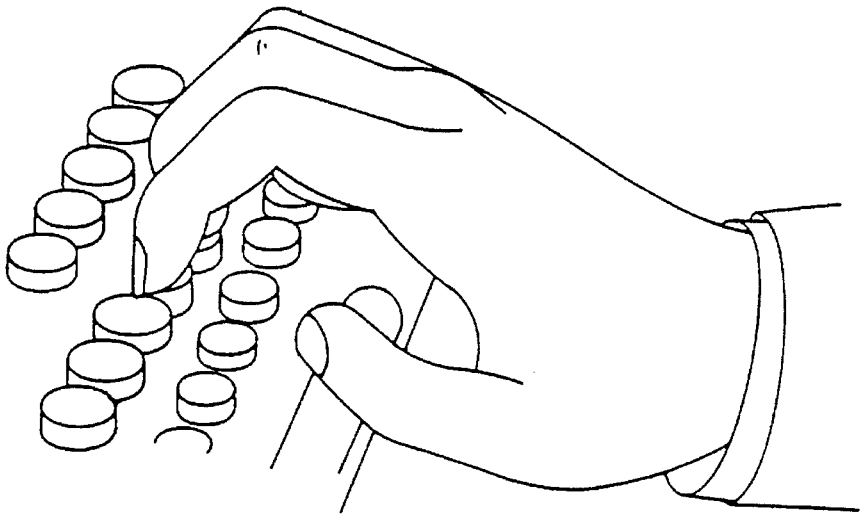
FIG. 1 is a perspective view of the prior art keyboard orientation.
Figure 2:
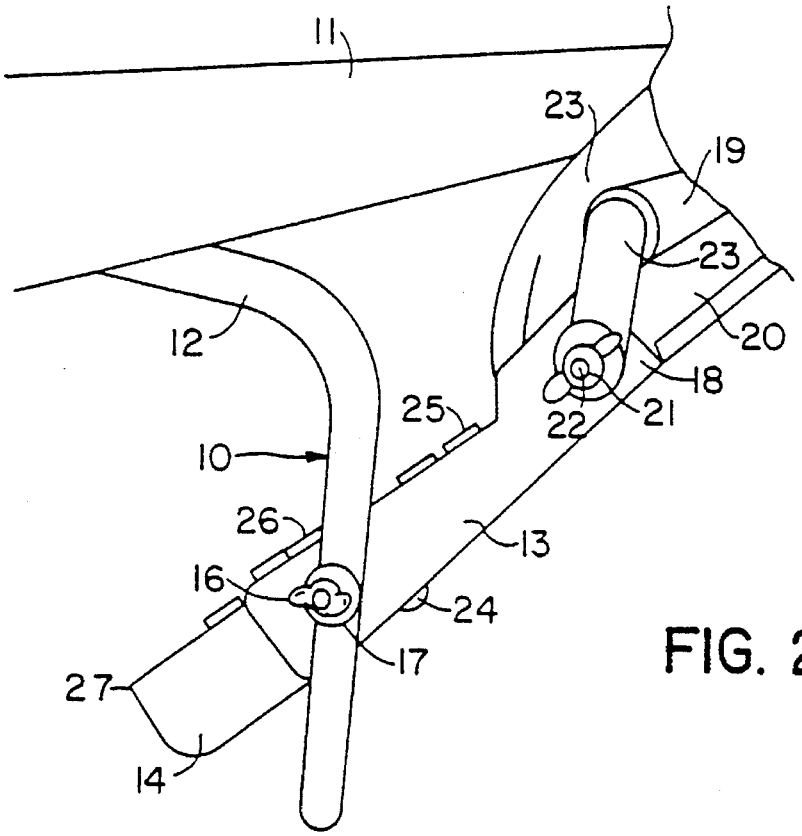
FIG. 2 is a perspective view of an embodiment of the present invention.

Referring first to FIG. 2, where are best shown the general features of the present invention, it can be seen that the keyboard positioning system, generally denominated by the numeral 10, includes a base or desk surface 11, positioning brackets 12 and 29 (not shown) connected to the base 11, clamping element 13 and 30 (not shown), which is adjustably connected to the positioning brackets 12 and 29, respectively, and a keyboard 14 of the conventional computer keyboard type.

The clamping element 13 is shown adjustably locked to the positioning bracket 12 by a wing nut and bolt combination 16 and 17. At the forward, or operating edge 18 of the clamping element 13 is a hand support 19 which extends across the front edge 20 of the keyboard and hand support holder 23 which is attached to the clamping element by means of a wing nut 21 and bolt 22. The clamping element 13 has a holding element 24 (set-screw) which holds the keyboard in the clamping element 13.

The hands 23 of the operator extend over the wrist support bar and hang downwardly toward the keys 25 of the keyboard 14.

The surface 26 of the keyboard is positioned at an angle of approximately 45° from the horizontal with the rear edge 27 lowered. More specifically, if the keyboard plan is defined as the plane which approximates the upper surfaces of all of the keys, then the preferred embodiment puts the keyboard plan from 30° to 60° down from the horizontal. The invention appears to be beneficial from 10° to 70° and offers some benefit from 0° to 70°.

Figure 3:
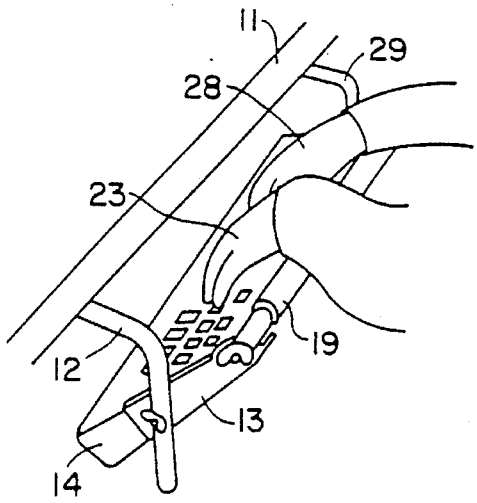
FIG. 3 is another perspective view of an embodiment of the present invention.

Referring now to FIG. 3, it can be seen that both of the hands 23 and 28 of the operator carry over the hand support bar and downward toward the keys 25.

Figure 4:
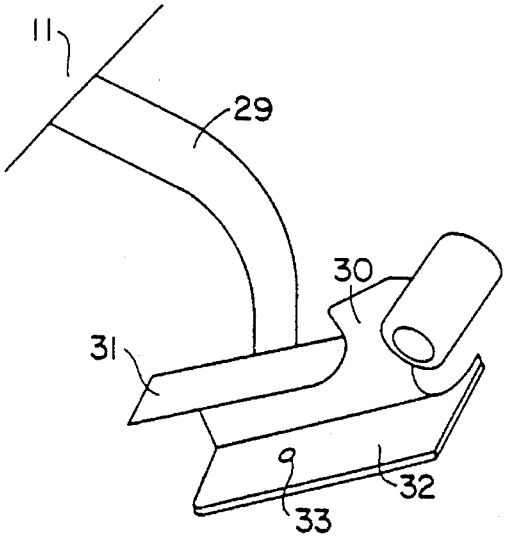
FIG. 4 is a perspective view of the holding clamp and positioning clamp which would be employed at the far end of the embodiments shown in FIGS. 2 and 3, but without the keyboard in the way.

Referring to FIG. 4, it can be seen that the inside surface of the clamp 30 is provided with an upper clamping flange 31 and lower clamping flange 32 which oppose one another and engage the side edge of the keyboard. A set screw 33 allows the clamping elements to securing engage the keyboard so that it does not slide out.

Figure 5:
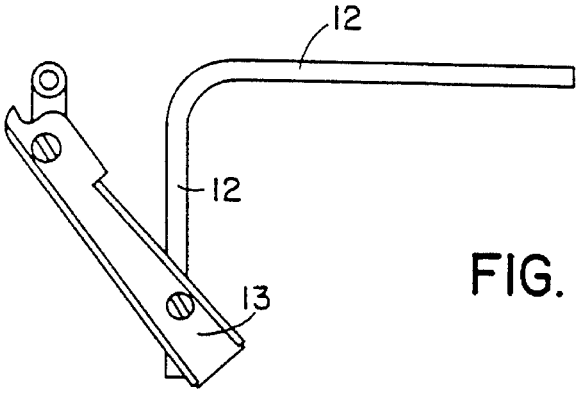
FIG. 5 is a perspective view of the inside view of the system which has the brackets in the embodiments shown in FIGS. 1 and 2.

FIG. 5 shows a view of the inside surface of the clamping system and because it is a side elevational view, the angularity of the clamp with respect to the vertical and horizontal portions of the positioning element can be more clearly seen.

Figure 6:
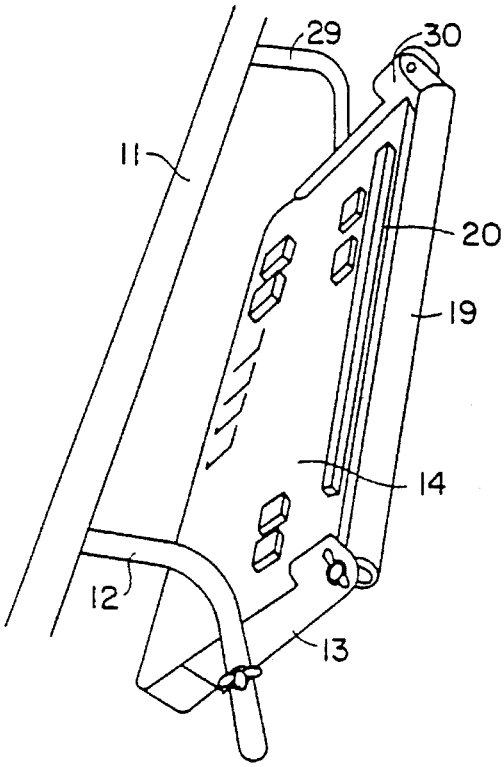
FIG. 6 is a perspective view of a preferred orientation of the system.
Figure 7:
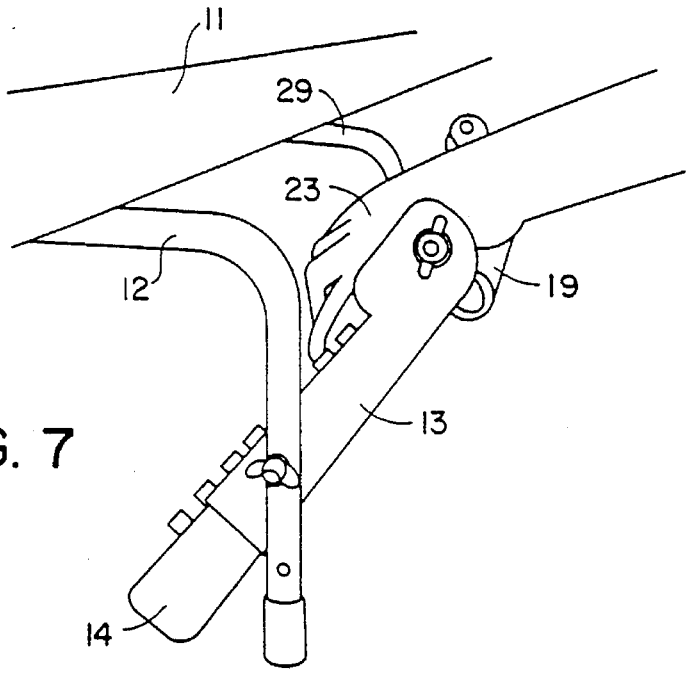
FIG. 7 is a perspective view of the orientation shown in FIG. 6.

FIG. 6 shows a perspective view of the system with the wrist support in the preferred orientation, i.e., below the front edge 20 of the keyboard 14. FIG. 7 is a closer view of the orientation in FIG. 6, showing the operator's hand 23.

FIG. 8 is a diagrammatic view of the preferred orientation of the operator's hand 28, the front edge 20 of the keyboard 14 and the hand support 19. The hand support 19 engages and supports the proximal palm 34. The palm 35 curves over (without touching) the front edge 20 of the keyboard 14 and the fingers 36 reach to the keys 25.

FIGS. 9 and 10 show the orientations of the hand support 19, the hand support holder 37, and the forward edge 38 of the clamping element 30. The hand support holder 37 (of which there is one at each end of the hand support) is formed of a plate 39 and a pin 40 mounted on the plate and extending outward from the plane of the drawing. The plate 39 is adjustably mounted to the clamping element 30 by the bolt 41 which extends through the slot 42 in the plate to allow both rotation and radial positioning of the pin 40. The pin 40 is shaped to engage the end of the hand support 19. The hand support 19 is formed of a hollow cylinder which can be easily cut to length and engaged by the pin 40, on one end, and a corresponding pin on the other end. In this way, the system can be adapted to the various widths of the keyboards.

Figure 11:
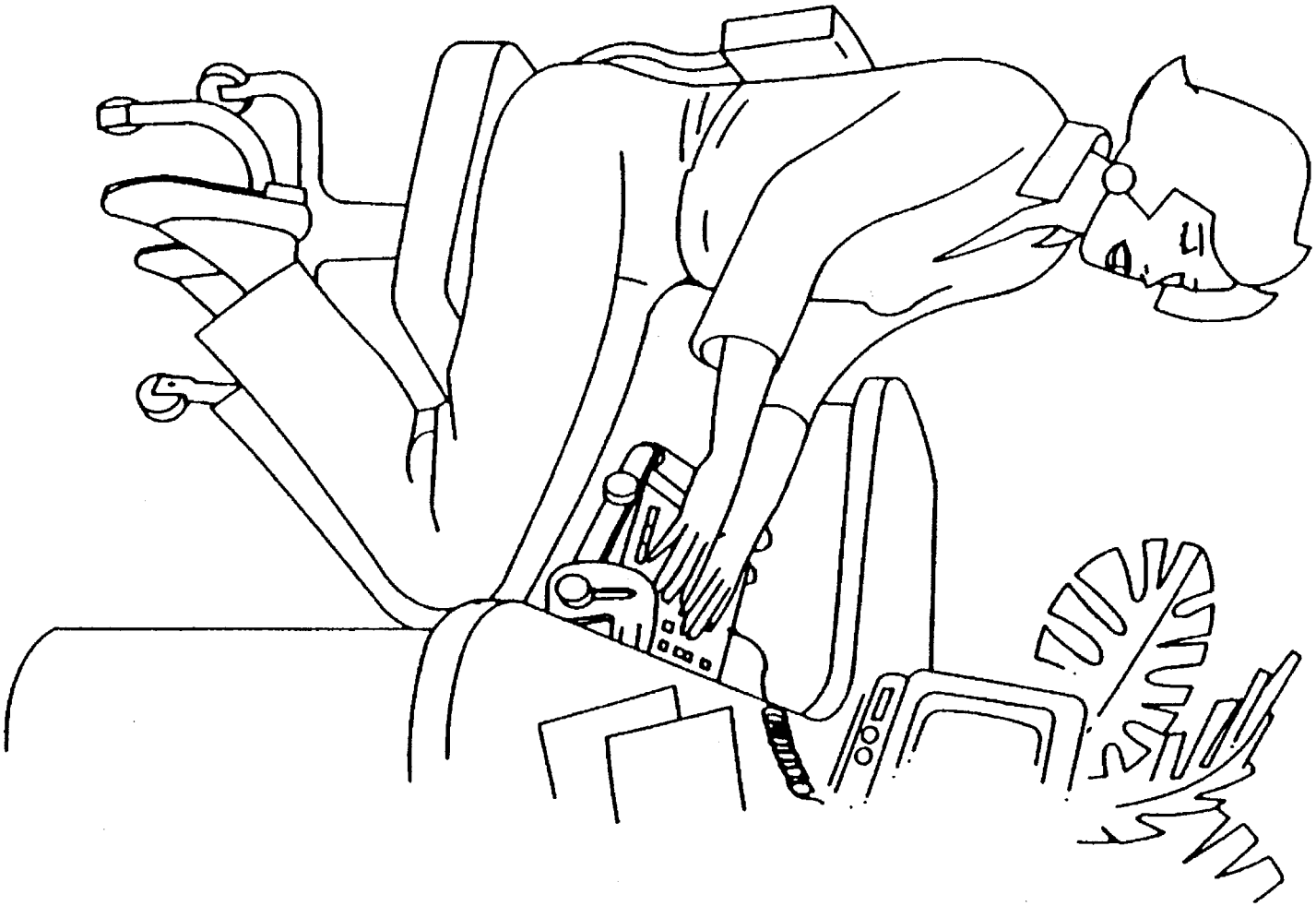
FIG. 11 is a perspective view of a second embodiment of the keyboard system in use.

FIG. 11 is a perspective view of a second embodiment of this invention in use.

Figure 12:
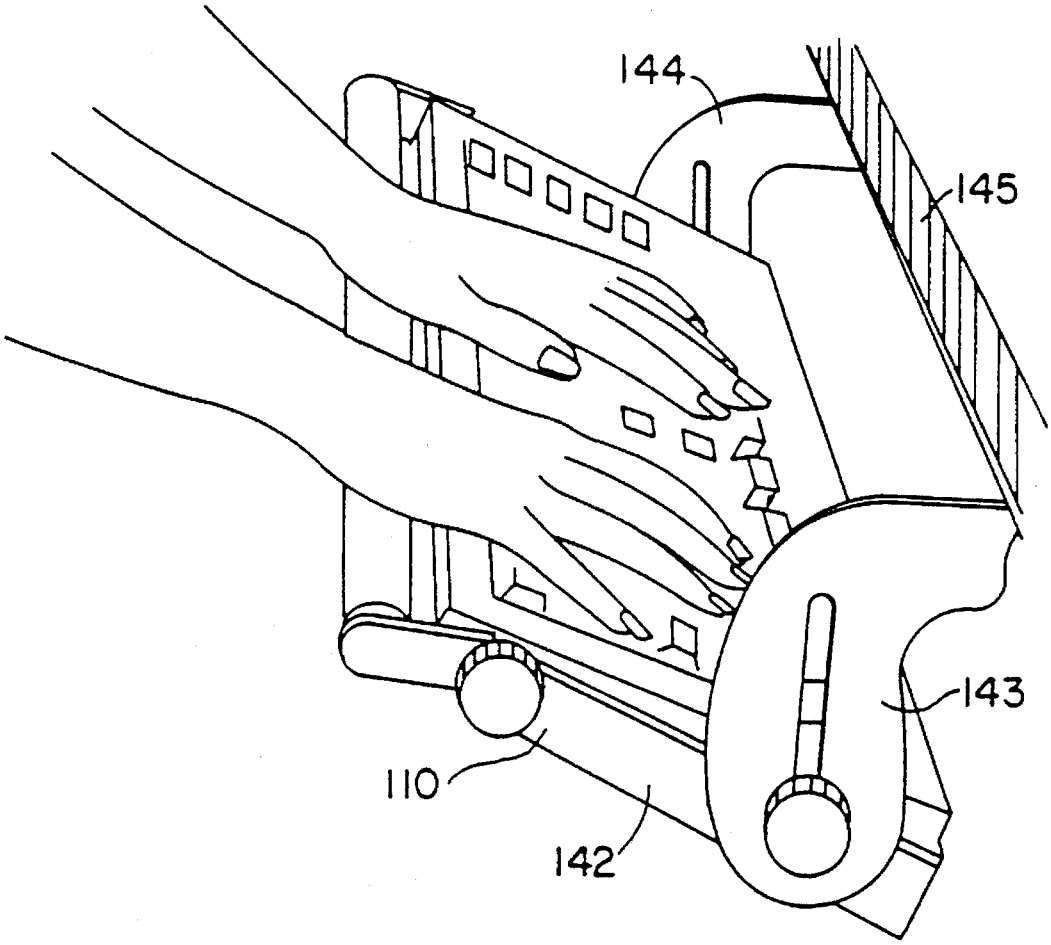
FIG. 12 is a close-up perspective view of the keyboard positioning system and angle adjustment capability.

FIG. 12 shows the keyboard positioning system 110, shown in FIG. 11, with a downward or backward keyboard slant and tray 142 positioned at the bottom of positioning brackets 143 and 144. The brackets are attached to desk 145.

Figure 13:
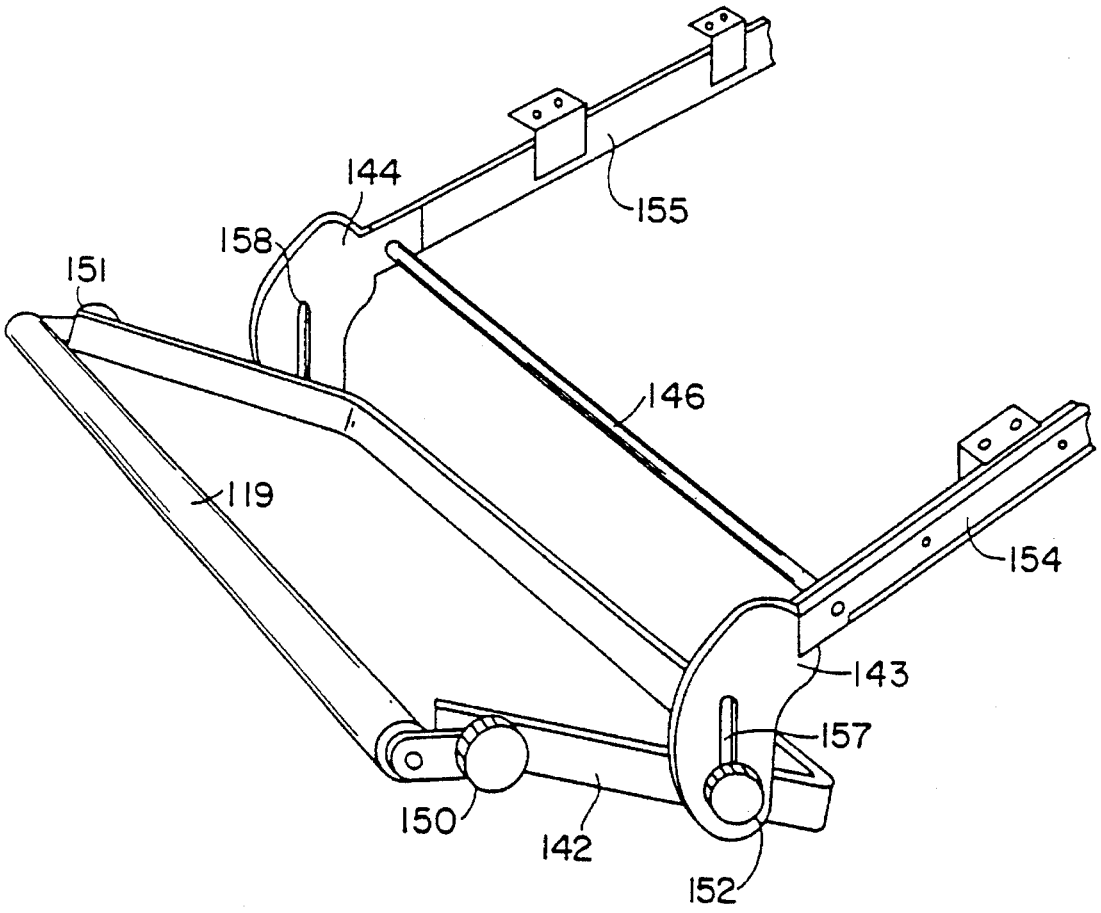
FIG. 13 is a perspective view of a second embodiment of the keyboard positioning system separated from a securing structure.

FIG. 13 shows the keyboard positioning system with hand support 19 attached by means of adjustment knobs 150 and 151 to tray 142 which holds a keyboard (not shown). The tray 142 is attached by height adjustment knobs 153 and 154 (not shown) on both the left and right sides of two positioning brackets 143 and 144. The positioning brackets may be connected to a pair of runners 154 and 155 which are connectable to a desk 145 (not shown). A support bar 146 is positioned between the positioning brackets 143 and 144, to make the entire structure very rigid. The positioning brackets 143 and 144 have knobs 152 and 153 which screw into the tray 142 and which allow for height and angle adjustment by slots 157 and 158 in each of the positioning buckets 143 and 144, respectively.

One special feature of the second embodiment is the means by which the system is attached to the desk. It has been found that the long-term benefits of the present invention can be best accomplished by maximizing the rigidity of the system as it is attached to a desk. However, the rigid and permanent installation tends to be time consuming and tends to leave permanent disfigurement (i.e., screw holes) in the underside of the desk. It has been found that these aspects of the permanent installation tend to discourage many potential users from trying the system and receiving its benefits. This embodiment is, therefore, provided with easily interchangeable clamps which allow the system to be quickly and easily attached to a desk for test use. The clamps do not require damage to the desk. In that way, the user can test the system with minimum objection and thereby discover its benefits.

Figure 14:
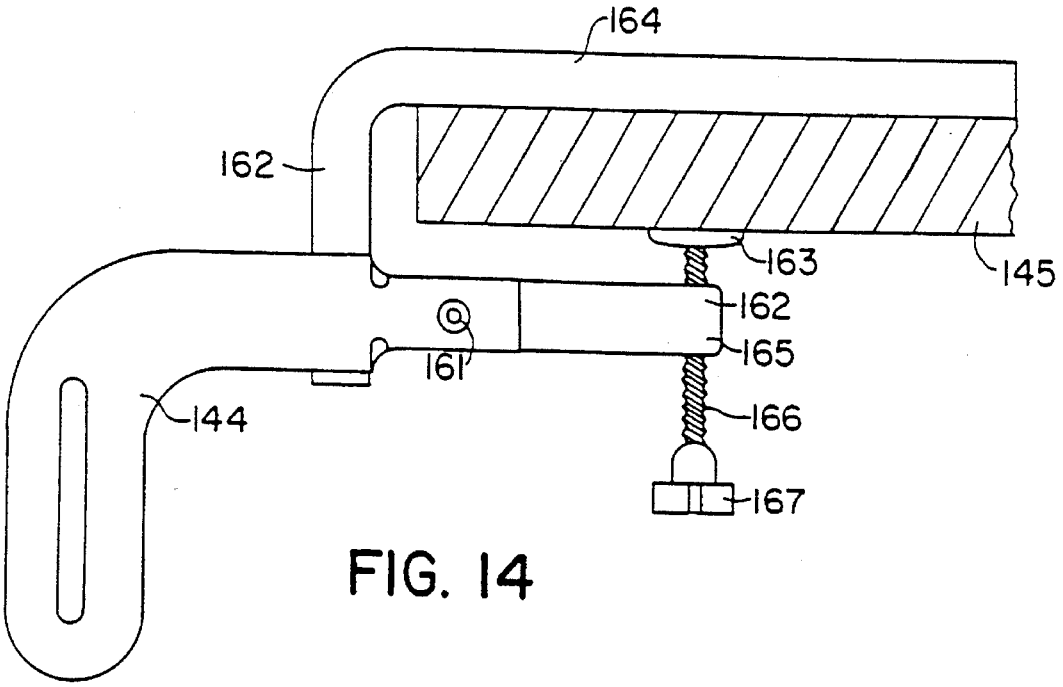
FIG. 14 is a side view of an interchangeable temporary clamp which can be used in the second embodiment.

FIG. 14 shows a side view of the attachment portion of the system. The positioning bucket 144 is rigidly attached to the clamp 162 by a threaded bolt 161, which passes through an aperture in the bracket 144 and engages a threaded aperture in the clamp 162. The clamp 162 has an upper arm 164 which engages the upper surface of the desk 145. The clamp also has a lower arm 165 which extends a substantial distance under the desk 145. The lower arm has a threaded vertical bore which carries a threaded shaft 166. The lower end of the shaft 166 has a clamping knob 167, which, when turned, allows the upper end of the shaft 166 and a pad 163 thereon to engage or disengage the lower surface of the desk. This clamp 162 and a similar clamp 168 (not shown) on the other bracket 143 allow the system to be easily and quickly attached to the desk for test purposes.

Figure 15:
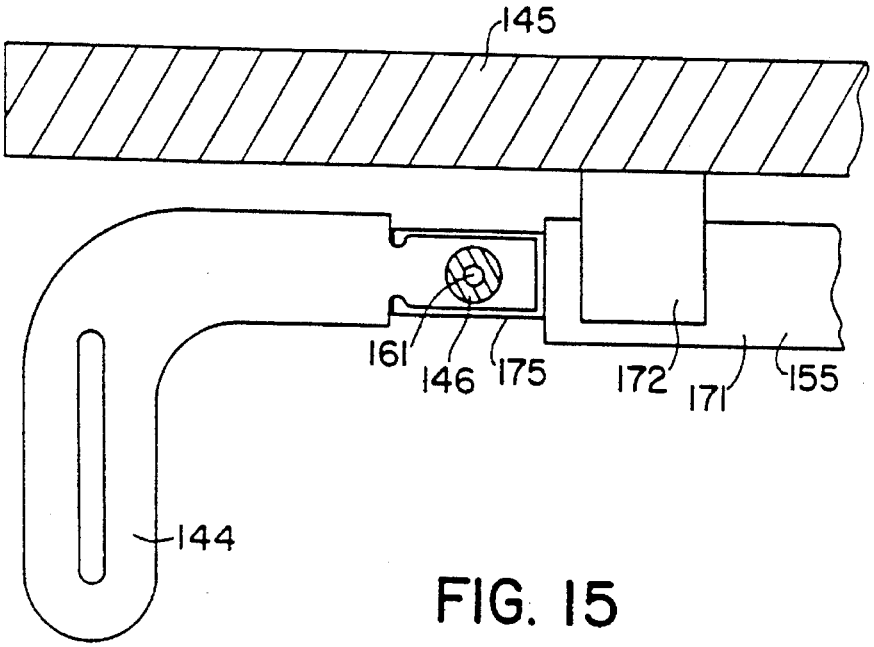
FIG. 15 is a side view of an interchangeable permanent bracket which can be used in the second embodiment.

Once the benefits of the present invention have become clear to the user during testing, it is possible to replace the clamps 162 and 168 with a more aesthetic and functionally superior attachment means shown in FIG. 15. This alternative arrangement not only provides optimally rigid support for the keyboard, but also allows the keyboard to be slid under the desk surface when the keyboard is not in use.

To convert from the clamp structure shown in FIG. 14 to the bolt-on structure shown in FIG. 15, the clamp 162 is separated from the bracket 144 by removing the bolt 161. The bracket 144 is then attached to the runner or bolt-on bracket 155 using the bolt 161. The bolt passes through the aperture in the bracket 144, through an aperture in the bolt-on bracket 155, and engages a threaded bore in the end of the stabilizing bar 146.

There are bolt-on brackets 154 and 155 for each of the brackets 143 and 144. The bolt-on brackets are mirror images of one another. Bolt-on bracket 155 consists of an elongated frame 171, several flanges (only flange 172 is shown in FIG. 15) which allow the frame to be rigidly bolted to the underside of the desk 145, and a slider 175. The slider is elongated and is slidably mounted in ball-beatings, for horizontal linear movement, in the frame 171. One end of the slider 175 is the pan of the bolt-on bracket 155 which is attached to the bracket 144. The sliding action of the bolt-on brackets allows the system to easily move the keyboard from a working position away from the desk to a storage position near and beneath the desk.

The present invention does something no other prior art product can do and that is to place and maintain the hand and wrist of the operator at or near a physiologically neutral position. The emphasis on the neutral position is critical because this is the position which really helps dedicated (full-time) keyboard users to minimize the damage caused by the bending of the median nerve and associated wrist structures.

The present invention's use of the sliders, in combination with a very thin holding tray, allows for the computer keyboard to be pulled up into the operator's lap. This brings recognized comfort, but more importantly, it allows and encourages a medically beneficial sitting position. That position acts to reduce upper torso stresses in the arms, neck, and upper extremities.

The adjustable palm bar, with its unique small diameter (¾" to 1⅛" in outer diameter, preferably ⅞"), allows for minute adjustments of the wrist position in relationship to the keys and for the overall comfort of the hand as it is placed over the computer keyboard.

The backward-tilt holding tray for the computer keyboard helps to dramatically reduce the amount of flexing the fingers must do while operating the keyboard. This contributes significantly to the reduction in overall stress to the associated tendons of the hand and wrist. It also reduces stress on the median nerve. No prior art product can make this claim. Only the unique position of the keyboard and the unique effect of the palm bar appear to achieve this important effect.

Figure 16:
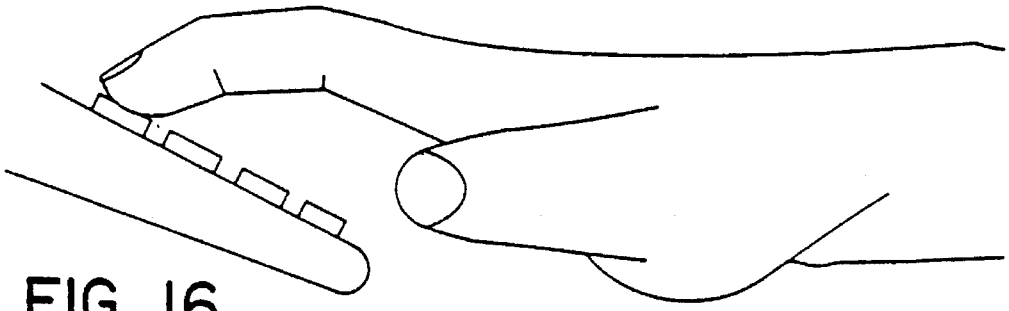
FIG. 16 is a diagramatic side view of a keyboard in a conventional position showing the hand extention necessary to reach the far rows of keys.

One important aspect of the keyboard orientation is the manner in which the position of the palm rest and the back-tilted orientation of the keyboard allows the fingers to reach the most-used keys with a maximum of hand and finger flexion (ventral bending) and minimum of hand and finger extension (dorsal bending). As shown in FIG. 16, the conventional keyboard orientation requires that a hand position which allows contact with the first row of keys also must involve extreme extension of the fingers to reach the upper row of the main keys. This extension of the fingers places severe strain on the muscles and tendons that cause extension of the fingers and, as a result, the hands are either fatigued or the wrist is forced out of the neutral position. The result, over a long term, is wrist damage and carpal tunnel syndrome.

Figure 17:
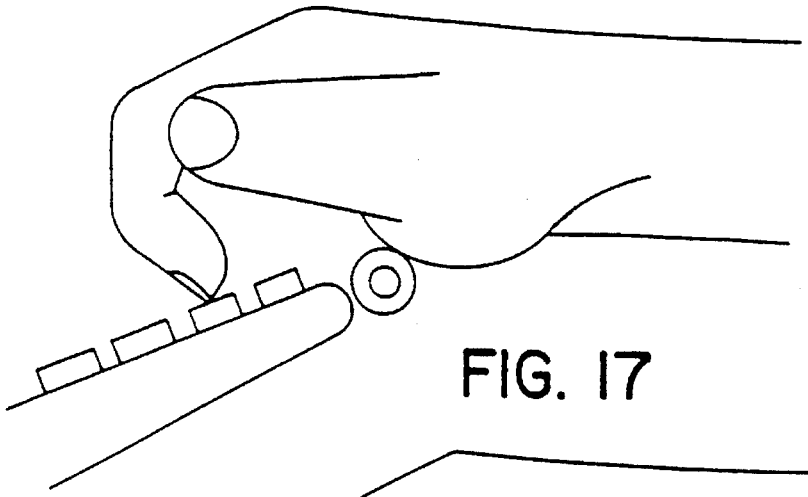
FIG. 17 is a diagramatic side view of a keyboard oriented to embody the principles of the present invention, showing the ease by which the user can reach the near keys.
Figure 18:
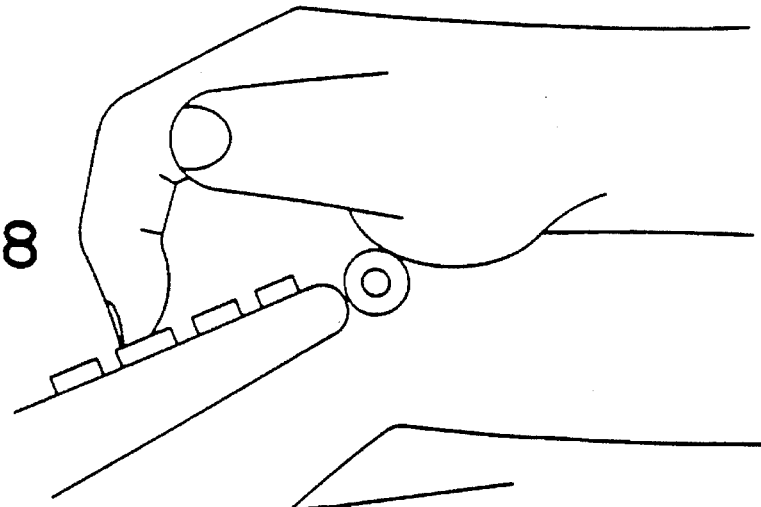
FIG. 18 is a diagramatic side view of a keyboard oriented to embody the principles of the present invention, showing the ease by which the user can reach the mid keys.
Figure 19:
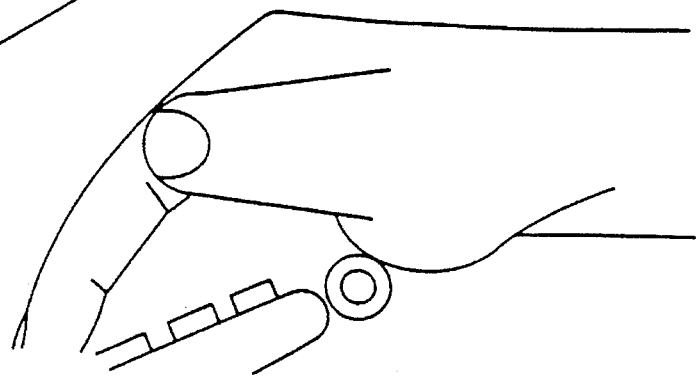
FIG. 19 is a diagramatic side view of a keyboard oriented to embody the principles of the present invention, showing the ease by which the user can reach the far keys.

The present invention, on the other hand, allows reaching the keys while keeping the fingers in flexure. FIGS. 17–19 show this effect graphically.

The present invention is the first device to be totally adjustable to all operators. The height and keyboard angle can be quickly and easily adjusted by the tightening knobs. The present invention has overall ability to address the unique physiological requirements of any operator, regardless of size. It allows for the correct straight up-and-down sitting posture for the back, at the same time, adding strong support for the arms. This is because the hands, via the palm rest, act to support the upper torso weight.

The present invention, while appearing similar in some respect to prior an products in the computer keyboard storage tray market, is radically different. The present invention is designed for one primary function and that is to provide a device to respond to the computer keyboard operator's physical needs. Primarily, this is accomplished by placing the operator's wrists in a continuous neutral position while the operator continues to operate the keyboard. This is achieved by three physical aspects, (1) combining a backward tilted holding tray with (2) a moveable approximately ¾" diameter round palm rest, and (3) attached to computer tray sliders. The ability of the three movable aspects to be minutely adjusted to the operator's own physical requirements maximizes the benefit.

The present invention develops a new aspect in the ergonomic field with regards to accepted sitting positions for keyboarding. It is generally accepted that the hand and arm should be held between 90 degrees and 70 degrees relative to the vertical upper arm. The present invention is particularly effective when the hand and arm are positioned at a downward angle of 110 degrees down to 160 degrees relative to the vertical upper arm. No other product has advocated using this extreme position. In field rials, the present invention has won the praise of its operators. The present invention is proving to be innovative in bringing relief with this new, radical position.

Some prior art units must be fully extended to be operated. That is, the unit must be fully extended from the work station to be operative and to allow the holding tray to be rotated to the desired position. Compared to the critical positions of the present invention in the backward tilt, the prior art units assume only limited positions. This does not allow for the minute adjustments afforded by the present invention. The critical position for the operator to maintain while operating the computer keyboard is a position which causes the wrist to remain in neutral position and reduces the repetitive extension (dorsal bending back) of the wrist. The present invention does this, but the prior art products do not enforce the optimum position of the hand and arm so that the wrist remains neutral throughout the operation of the computer keyboard. The prior art wrist rests serve as support for the wrist, rather than the palm. The whole wrist must be placed on the prior art support tray. The present invention requires only the distal surface of the base part of the palm to rest on the small diameter round bar. The fatty tissue in the palm allows for a natural cushion. The prior art units require the wrist, with its veins and tendons close to the skin surface, to be in constant and potentially damaging contact with the wrist rest.

An important feature of the palm rest is that it allows for greater movement of the hand with..less obstruction from the supporting surface of the hand support. With the prior art units, the whole wrist is in contact with the supporting surfaces. The present invention only requires contact between the support and the base of the operator's palms. This allows for a more natural movement of the fingers and hands, reducing stress and fatigue to the operator.

Vibration is an important aspect to consider when operating the computer keyboard on a continuous basis. It is analogous to being in a rough riding car versus a smooth riding car. For the dedicated keyboard operator, it is important for the keyboard to provide a firm, energy absorbing or "damped" surface. If this is not accomplished, then the operator cannot fully relax his or her upper torso when his or her hands are placed on the palm rest or wrist rest. The result of not having a secure-feeling resting surface for the hands is the tightening of the neck and arm muscles. This is extremely harmful to a full-time keyboard operator.

The prior art units are described as convenient storage systems for the computer keyboard, and they all promoted for the comfort of the computer keyboard operator. However, the majority of the prior an products vibrate to a great degree in use. One of the reasons is the perceived need to have a product that will appeal to everyone's needs. This means products with a wide range of versatility. In the process of trying to achieve this market capability, the products are designed in an unstable form. This unstable form interfere with their ability to be very stable in use and to absorb the continuous vibration from the continuing key strokes.

The present invention has carefully taken into account the need to provide the dedicated (full-time) operator with a sturdy work platform. The present invention is designed much as an athlete's apparatus for a sport would be designed. It must do the job and hold up under duress and provide maximum comfort to the users. An operator who is subject to hand support vibration while using a computer keyboard for extended periods of time, will suffer quickly from fatigue and this may result in the injuries now being experienced in the work place. While the present invention provides for the maximum comfort of the operator, the device is primarily intended to encourage the optimum position for the computer keyboard operator and that is the wrist neutral position. Therefore, the present invention's concept of comfort for the operator includes the long-term comfort which results from the design function of having the computer keyboard operator maintain this neutral, and therefore less injurious, hand and wrist posture. The other prior an products do not recognize this specific mode of operation. It is only maximally achievable with the special (approximately) ¾" diameter adjustable palm bar and backward tilted keyboard holding tray in conjunction with the mechanical design and superior construction of the materials used to make the present invention.

The present invention also focuses on the "palm only" resting on the palm support. The prior an units show or describe the whole wrist resting on the wrist rest. In order for the operation of the prior art units, the wrist must be moved continuously over the surface to reach the keys. That does not allow for the wrist and hand to be placed in a continuous neutral position. The fingers must be extended (bent dorsally) for each key stroke of operation. The present invention allows for the fingers to be moved in a non-stress downward movement, without significant need for full extension (dorsal bending) of the fingers.

An important aspect of the key stroke operation on the backward tilted keyboard is the ability to keep the hand in a semi-cupped position. This allows for the hand to work without being forced to reach, in extension, for the computer keyboard keys. This, incidentally, adds to the speed of the operator's typing ability, because the fingers have less range to travel in the stroking of the keys. Over a short period of time, this adds to the productivity of the operator with much less fatigue. The present invention, while somewhat similar in oven appearance to some prior art units, is uniquely different from any other prior art product. The present invention is designed to address the dedicated (full-time) keyboard user's physical need for ergonomic adjustment while operating the computer keyboard. No other product has been effectively designed to do this.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described what is claimed as new and desired to be secured by letters patent is:

What is claimed is:

1. A device for mounting a keyboard to a base, the keyboard having a front surface and a top surface, the device comprises:

(a) first and second bracket member engagable with the base;

(b) a support tray comprising a front portion, a rear portion, and a support surface, said support surface being engagable with the keyboard, said rear portion being in closer proximity to the base than said front portion when said support tray is engaged with the base, said support tray being connected to said first and second bracket members and disposed such that said rear portion is disposed below said front portion; and (c) a palm rest, said palm rest being movably mounted on said support tray from a position at least substantially adjacent the front surface of the keyboard to a position above the top surface of the keyboard while said rear portion of said support tray is below said front portion of said support tray.

2. The device of claim 1, wherein said support tray is movably connected to said first and second bracket members.

3. The device of claim 2, wherein said support tray is rotatably connected to said first and second bracket members.

4. The device of claim 1, wherein said palm rest is connected directly to said support tray.

5. The device of claim 4, wherein said palm rest is rotatably connected to said support tray.

6. The device of claim 1, wherein said first and second bracket members are engaged directly with the base.

7. The device of claim 6, wherein said first and second bracket members are secured to the base.

* * * * *